United States Patent [19]

Hawranick

[11] Patent Number: 4,736,550

[45] Date of Patent: Apr. 12, 1988

[54] INTERLOCKING TETRAHEDRAL BUILDING BLOCK AND STRUCTURAL SUPPORTING SYSTEM

[76] Inventor: Stephan Hawranick, 53 Irving Place, New York, N.Y. 10003

[21] Appl. No.: 928,263

[22] Filed: Dec. 18, 1986

[51] Int. Cl.[4] ..... E04C 1/12

[52] U.S. Cl. ..... 52/574; 52/575; 52/609

[58] Field of Search ..... 52/575, 574, 609, 608; 446/124, 125, 128; 405/33; 404/41

[56] References Cited

U.S. PATENT DOCUMENTS

| | | | |
|---|---|---|---|
| 194,250 | 4/1877 | Krackowizer | 52/575 |
| 1,618,780 | 2/1927 | Reintjes | 52/575 |
| 4,207,715 | 6/1980 | Kitrick | 52/DIG. 10 |

FOREIGN PATENT DOCUMENTS

| | | | |
|---|---|---|---|
| 118229 | 2/1947 | Sweden | 52/574 |
| 2613 | 12/1872 | United Kingdom | 52/574 |

*Primary Examiner*—John E. Murtagh

*Attorney, Agent, or Firm*—Darby & Darby

[57] ABSTRACT

A building block, which is adapted to be assembled with other such blocks to form a structural unit, includes a tetrahedrally shaped block body. The block body has an upper edge, two upper triangular faces sloping downwardly and mutally diverging from the upper edge, a lower edge, and two lower triangular faces sloping downwardly and mutually converging to the lower edge. The lower edge is disposed orthogonally and spaced below the upper edge. The building block further includes a hooking lip formed on and projecting from each of its upper and lower faces. The hooking lip of one block is adapted to interlockingly engage a hooking lip of another block. When the building blocks are so engaged, they may be assembled in an overlapping, geometric, self-supporting arrangement suitable for load bearing applications.

3 Claims, 10 Drawing Sheets

INTERLOCKING TETRAHEDRAL BUILDING BLOCK AND STRUCTURAL SUPPORTING SYSTEM

BACKGROUND OF THE INVENTION

1. Field of the Invention

This invention relates to a building block construction for use in the building and construction industry, as well as for use in educational, developmental or toy construction sets, and more particularly relates to an interlocking tetrahedral block design which, when interfitted with other similar blocks provides a structural system suitable for load bearing applications.

2. Description of the Prior Art

A geometric structure formed of a plurality of tetrahedrally shaped tensegrity modules is disclosed in U.S. Pat. No. 4,207,715 (Fuller). The modules are described in the Fuller patent as being formed from a series of compression members, or struts, joined together at a center point, and a number of tension elements joined to the ends of the compression members. The compression numbers define four equilateral triangular faces on the module, and form the edges of each triangular face. Each module may be covered by a skin or membrane to define a closed outer surface.

As shown in FIG. 8 of the Fuller patent, the tetrahedral modules may be arranged so that their triangular faces abut and overlap (with the vertices of the abutting triangular faces in nonalignment) to form a continuous overlapping arrangement which defines and encircles a pyramidal dimple.

The tetrahedral modules disclosed in the Fuller patent may be arranged to form a variety of geometric structures. However, these structures relay on tension forces to maintain their form, that is, the tension forces exerted by each module on its adjacent module contribute to the tensile integrity of the whole structure. The structure must be assembled as a whole, and supported during assembly, and then placed under tension to maintain structural integrity.

Because each module is not "self-supporting" and an external scaffolding is needed to support the module assembly during its construction, the applicability of the module of block construction disclosed in the Fuller patent is limited.

OBJECTS AND SUMMARY OF THE INVENTION

It is an object of the present invention to provide a building block construction that overcomes the disadvantageous features of the block disclosed in Fuller U.S. Pat. No. 4,207,715.

It is another object of the present invention to provide a particular block construction that is adapted to interlock with similar constructions to form a geometric arrangement.

It is a further object of the present invention to provide a structure suitable for load bearing applications formed from a plurality of identical, interconnected building blocks.

It is still a further object of the present invention to provide a building block adapted to be interlockingly joined together in a variety of geometric structural arrangements, in which each arrangement is self-supporting during its assembly, that is, requires no external or secondary support.

In accordance with one embodiment of the present invention, a building block, which is adapted to be assembled with other such blocks to form a structural unit, includes a tetrahedrally shaped block body. The block body has an upper edge, two upper triangular faces sloping downwardly and mutually diverging from the upper edge, a lower edge, and two lower triangular faces sloping downwardly and mutually converging to the lower edge. The lower edge is disposed orthogonally and spaced below the upper edge.

The building block of the present invention further includes a hooking lip formed on and projecting from each of its upper and lower faces. A hooking lip of one block is adapted to interlockingly engage a hooking lip of another block. When the building blocks are so engaged, they may be assembled in an overlapping, geometric, self-supporting arrangement suitable for load bearing applications when subjected to a perimetal tension ring.

Preferred forms of the building block and structural supporting system, as well as other objects, features and advantages of this invention, will become apparent from the following detailed description of illustrative embodiments thereof, which is to be read in connection with the accompanying drawings.

DETAILED DESCRIPTION OF THE PREFERRED EMBODIMENTS

Figure 2:
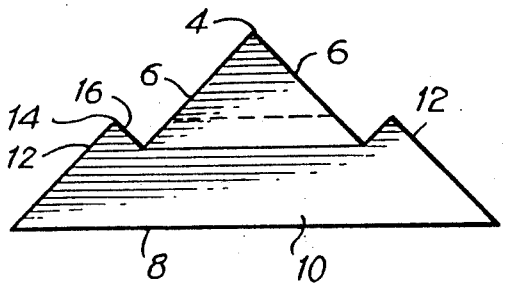
FIG. 2 is a side elevation view of the block shown in FIG. 1 viewed in th direction of arrow A.
Figure 1:
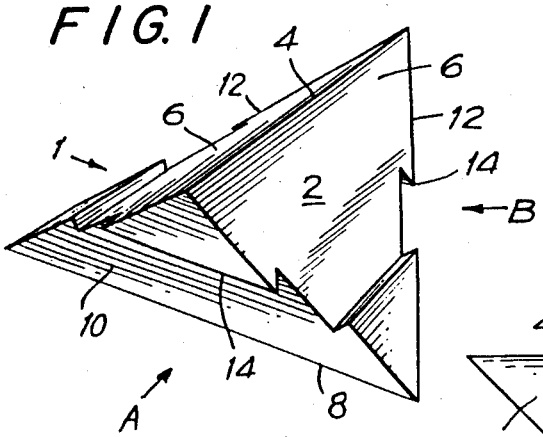
FIG. 1 is a perspective view of the building block formed in accordance with a first embodiment of the present invention.
Figure 3:
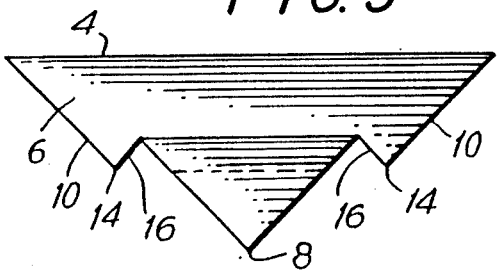
FIG. 3 is a side elevation view of the block shown in FIG. 1 viewed in the direction of arrow B.
Figure 4:
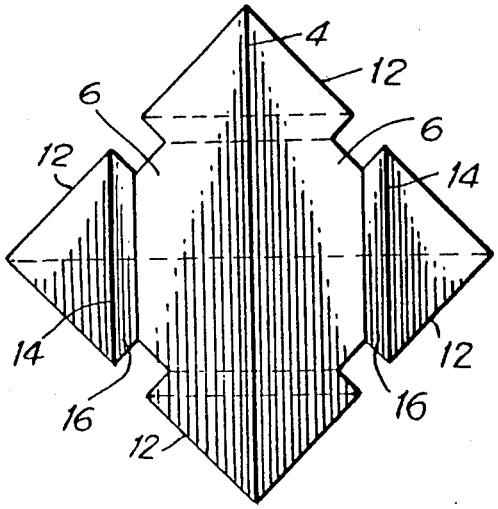
FIG. 4 is a top plan view of the block shown in FIG. 1.
Figure 5:
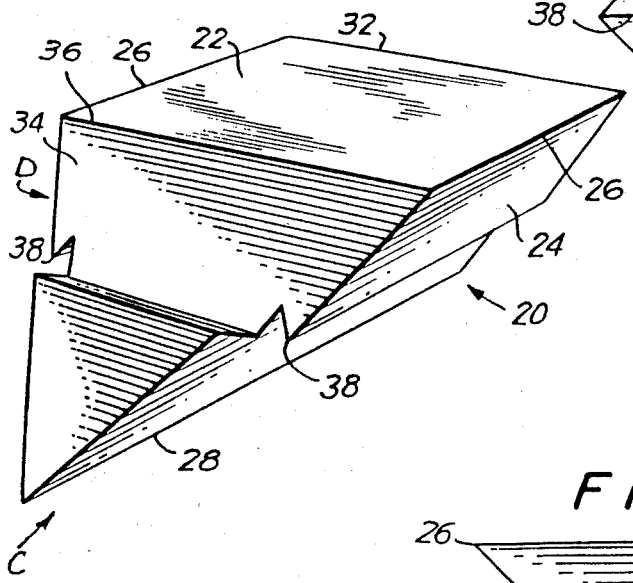
FIG. 5 is a perspective view of an edge building block formed in accordance with a second embodiment of the present invention.
Figure 6:
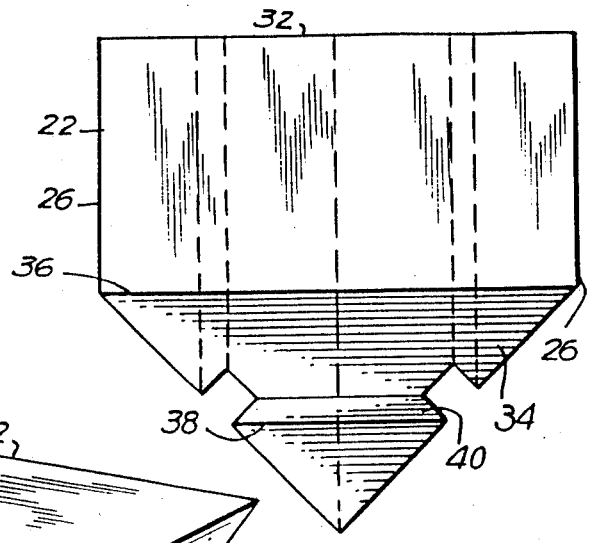
FIG. 6 is a top plan view of the block shown in FIG. 5.
Figure 7:
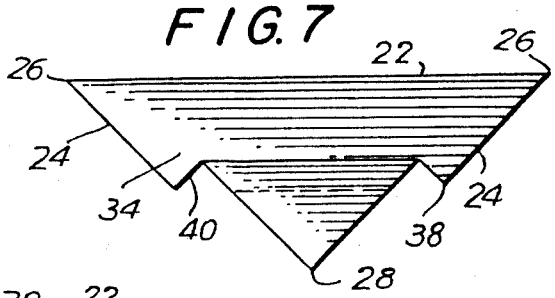
FIG. 7 is a side elevation view of the block shown in FIG. 5 viewed in the direction of arrow C.
Figure 8:
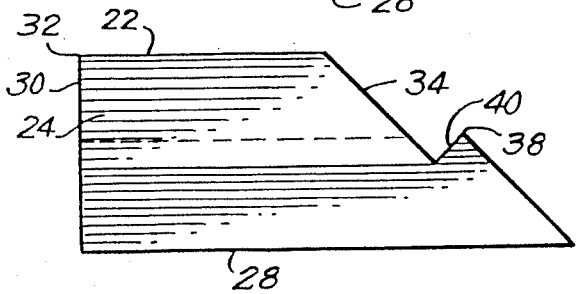
FIG. 8 is a side elevation view of the block shown in FIG. 5 viewed in the direction of arrow D.
Figure 10:
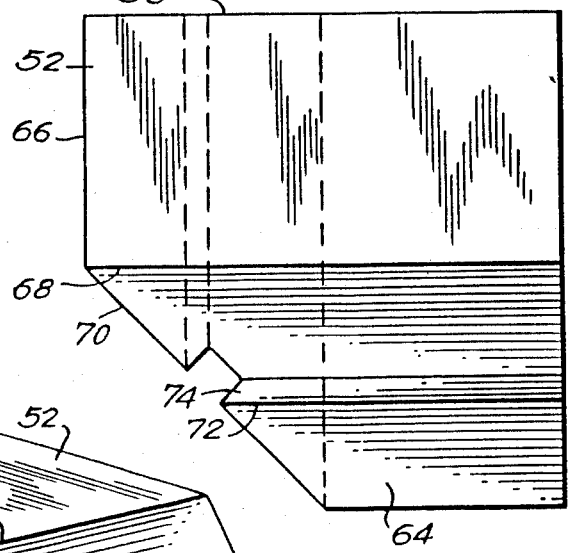
FIG. 10 is a top plan view of the block shown in FIG. 9.
Figure 9:
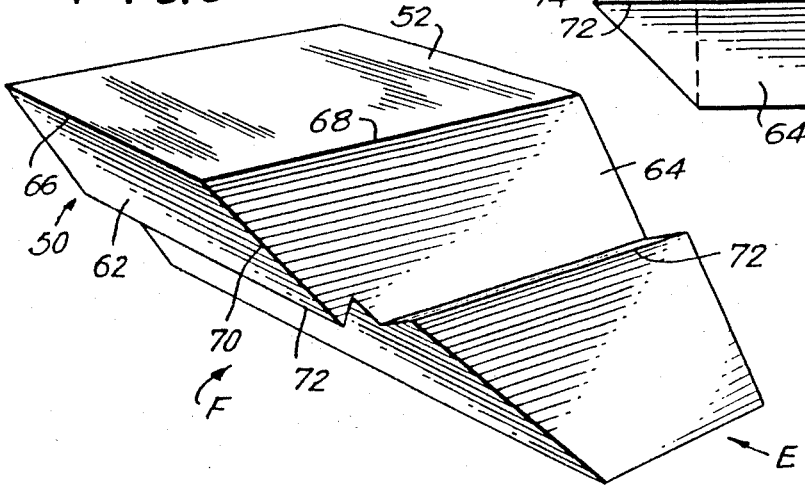
FIG. 9 is a perspective view of a corner building block formed in accordance with a third embodiment of the present invention.
Figure 11:
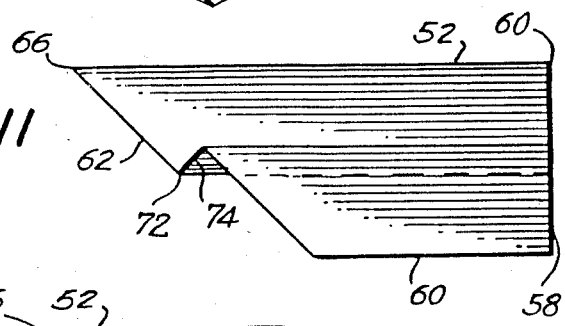
FIG. 11 is a side elevation view of the block shown in FIG. 9 viewed in the direction of arrow E.
Figure 12:
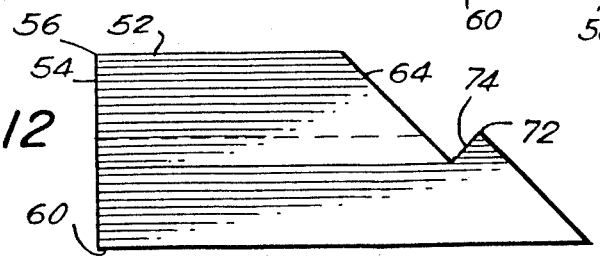
FIG. 12 is a side elevation view of the block shown in FIG. 9 viewed in the direction of arrow F.

Referring initially to FIGS. 1-4 of the drawings, it will be seen that a first embodiment of a building block 1 adapted to be assembled with other such blocks to form a structural unit includes a block body 2 formed in the shape of a tetrahedron. The block body 2 has an upper edge 4, and two triangular upper faces 6 which slope downwardly and mutually diverge from the upper edge 4.

The block body 2 further includes a lower edge 8, and two triangular lower faces 10 which slope downwardly and mutually converge to define the lower edge 8. The lower edge 8 of the block body is disposed orthogonally to the upper edge 4.

The block body 2 includes side edges 12 surrounding the block, and over the length of which the upper faces 6 are joined to the lower faces 10.

A hooking lip 14 is formed on and projects from each upper and lower face 6, 10 of the block body 2. Each hooking lip 14 preferably projects perpendicularly from its respective face on which it is formed, and defines an exposed lip face 16. The hooking lips 14 formed on the upper faces 6 extend parallel to the upper edge 4 across their entire respective face and between adjacent side edges 12, and, similarly, the hooking lips 14 formed on the lower faces 10 extend parallel to the lower edge 8 across their respective face form side edge to side edge.

A number of blocks may be interconncted to form a geometric assembly by interlocking their hooking lips 14 so that the lip face 16 of one block contacts the lip face 16 of another block.

Figure 13:
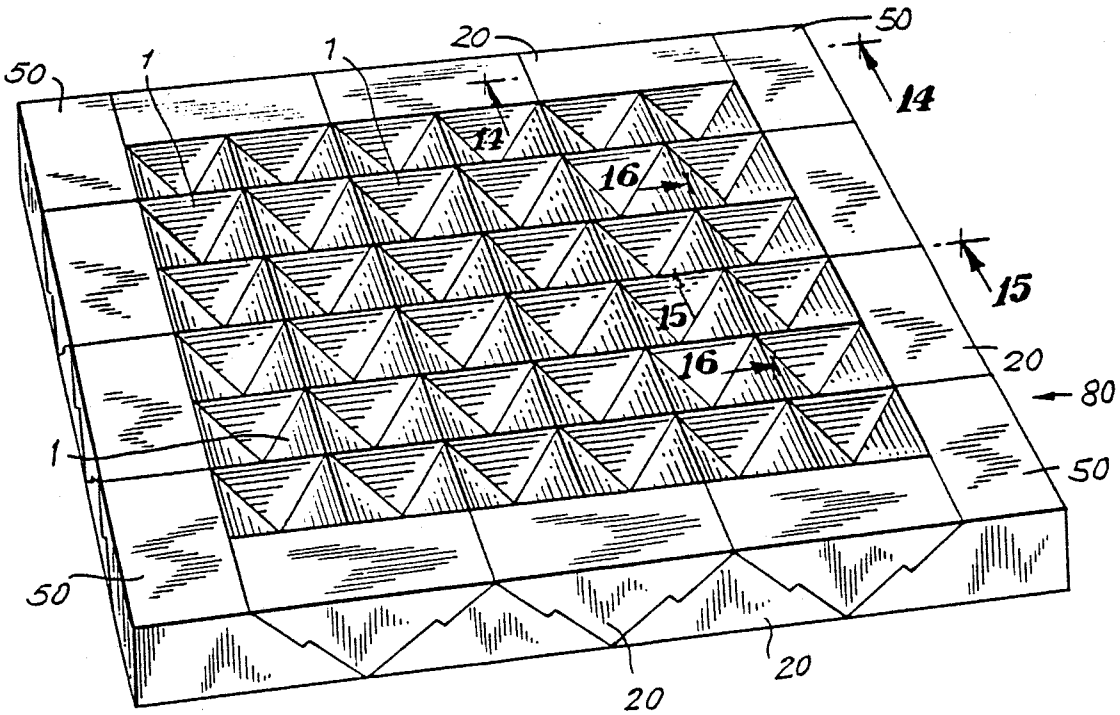
FIG. 13 is a perspective view of a horizontal support structure formed from an assembly of building blocks shown in FIGS. 1–12.
Figure 14:
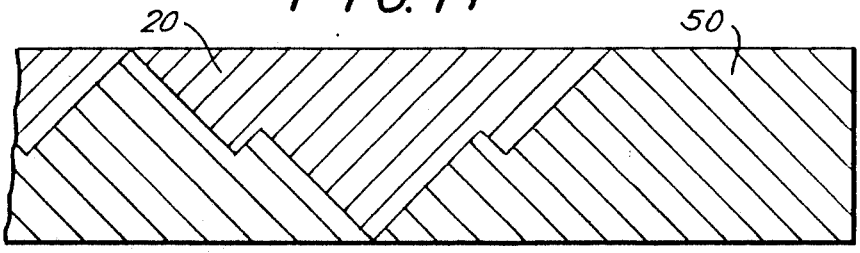
FIG. 14 is a section view of the structure shown in FIG. 13 taken along line 14—14 of FIG. 13.
Figure 15:
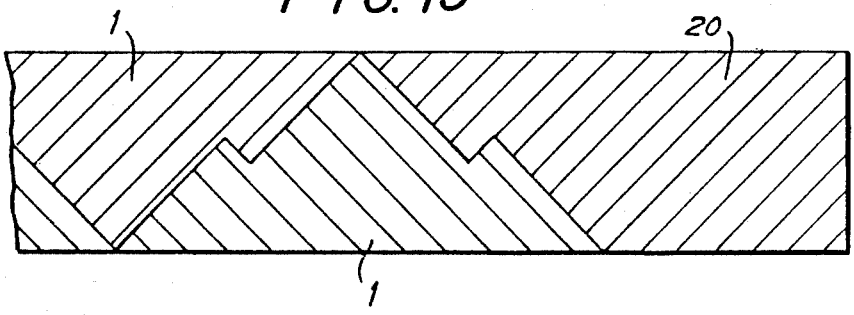
FIG. 15 is a section view of the structure shown in FIG. 13 taken along line 15—15 of FIG. 13.
Figure 16:
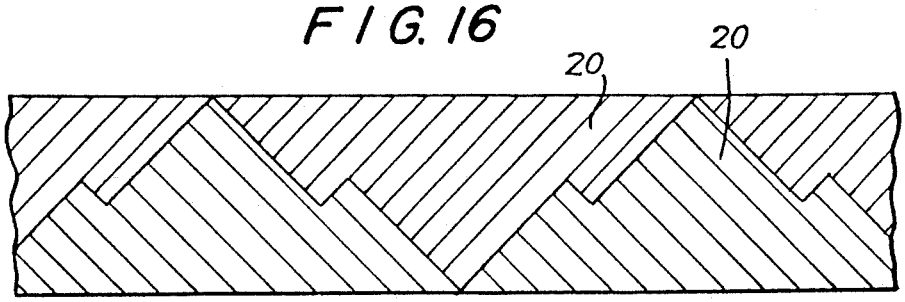
FIG. 16 is a section view of the structure shown in FIG. 13 taken along line 16—16 of FIG. 13.
Figure 18:
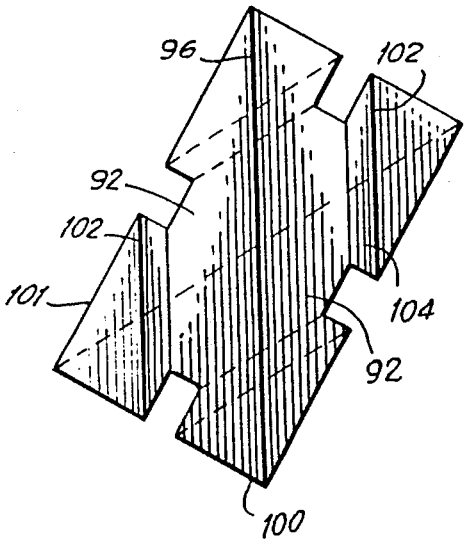
FIG. 18 is a top plan view of the building block shown in FIG. 17.
Figure 17:
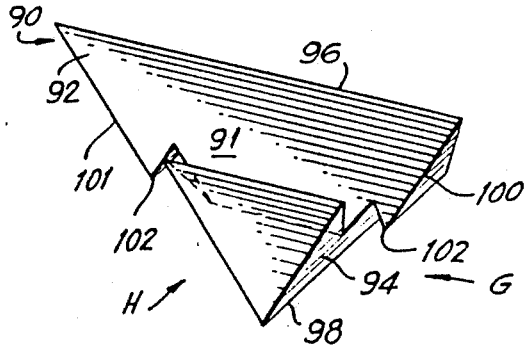
FIG. 17 is a perspective view of a building block formed in accordance with a fourth embodiment of the present invention.
Figure 19:
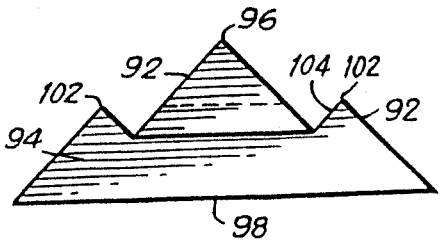
FIG. 19 is a side elevation view of the block shown in FIG. 17 viewed in the direction of arrow G.
Figure 20:
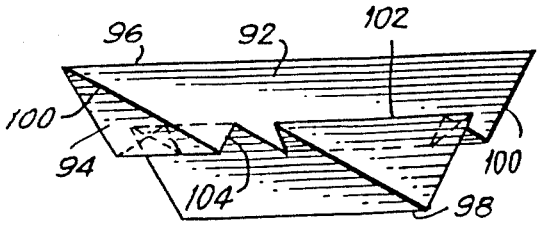
FIG. 20 is a side elevation view of the block shown in FIG. 17 viewed in the direction of arrow H.
Figure 22:
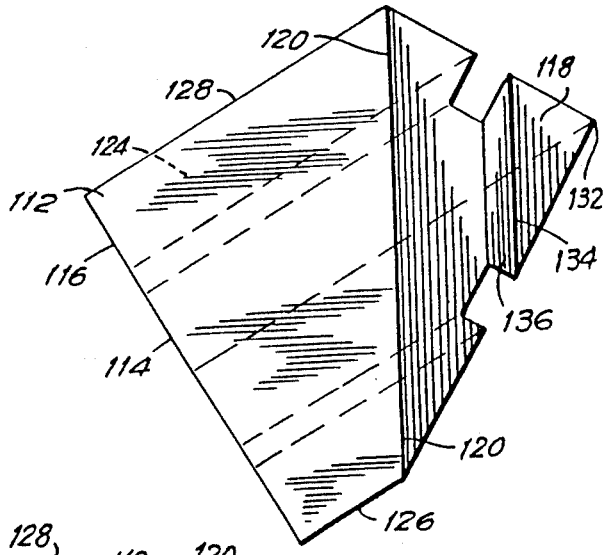
FIG. 22 is a top plan view of the building block shown in FIG. 21.

Thus, in such an assembly, each block fully supports the next adjacent block, and need not be compressed or tensioned to provide such support. This is an advantageous feature to the present invention because it allows the assembly to be formed one block at a time to form a horizontal supporting structure, as shown in FIG. 13, without the need for an external, secondary support for the assembly other than a perimetal tension ring which is applied after the final structure has been assembled.

The preferred form of the tetrahedral building block 1, as illustrated in FIGS. 1-4, includes triangular faces 6, 10 which are equilateral, that is, the side edges 12 and the upper and lower edges 4, 8 of the block are all equal in length, and define interior angles of about 60 degrees at each corner of each triangular face. The hooking lips 14, in the preferred form, extend from one side edge 12 to an adjacent side edge 12 at points on the side edges about slightly less than one half the length of the side edge 12, as measured from the vertices of the triangular faces.

Th length of each hooking lip 14 formed on the faces of the building block body 2 is the same, so as not to limit the number of possible orientations in which the block may be positioned to join it with another block. Thus, the building blocks are symmetrical about their upper and lower edges 4,8, when the blocks are viewed in plan.

FIGS. 5-8 iillustrate a preferred form of an edge block 20, formed in accordance with a second embodiment of the present invention, which is adapted to interconnect with similar edge blocks and with the tetrahedral block 1 of FIGS. 1-4, discussed previously.

The edge block 20 is formed with a rectangular upper face 22, two triangular side faces 24 which extend from the opposite edges 26 of the upper face 22 and which mutually converge to a lower edge 28, a triangular outer face 30 which extends perpendicularly from an outer edge 32 of the upper face 22 to the lower edge 28, and a sloping inner face 34 which extends from an inner edge 36 of the upper face 22 and slopes downwardly to the lower edge 28 and away from both the inner and outer edges 36, 32.

Th edge block 20 is designed to conform to the shape of the tetrahedral block 1 of FIGS. 1-4, and to form the perimeter of a structural assembly of horizontally disposed, interconnected tetrahedral blocks. Thus, the slope of the inner face 34 complements the slope of the lower faces 10 of the tetrahedral block 1.

Furthermore, the edge block 20 includes a hooking lip 38 and lip face 40 formed on and projecting preferably perpendiularly to the inner face 34, and situated on the inner face so as to be adapted to engage a hooking lip 14 of the tetrahedral block.

The sloping side faces 24 of the edge block 20 also include hooking lips 38 and lip faces 40 configured similarly to the lip formed on the inner face 34, that is, they project preferably perpendicularly to their respective side faces. The side face lips 38 extend across the entire length of the side faces 24 from the inner face 34 to the outer face 30 and run parallel to the upper face 22.

The side faces 24 are preferably sloped at an angle of 45 degrees from the upper face 22, and the hooking lips 38 are preferably situated across the middle of the side faces 24. This allows a number of edge blocks 20 to b interlocked, by inverting alternate blocks, to form the periphery or border of a horizontal assembly of blocks, as shown in FIG. 13.

According to a third embodiment, a corner block 50, formed with structural features similar to the edge block 20 previously discussed, is used to complete the perimeter of such a horizontal structure, and a perferred form of the corner block is illustrated by FIGS. 9-12.

The corner block 50 includes a rectangular upper face 52, a first outer face 54 joined to the upper face 52 at a first outer edge 56 of the upper face 52, and extending perpendicularly to the upper face, a second outer face 58 which is joined to the upper face 52 at a second outer edge 60 of the upper face, and which extends perpendicularly to each of the first outer face 54 and the upper face 52, a rectangular bottom face 61 disposed parallel to and partially beneath the upper face 52, and first and second sloping side faces 62, 64 respectively.

The first side face 62 is joined to a side edge 66 of the upper face 52 and slopes inwardly from the side edge 66 to the bottom face 61, and partially beneath the upper face 52. The second side face 64 is joined to an inner edge 68 of the upper face 52 and slopes outwardly from the inner edge 68 toward the bottom face 61. Thus, the first and second side faces 62, 64 are joined together at a common inner corner edge 70.

Each of the first and second side faces 62, 64 are sloped with respect to the upper face 52 at an angle which complements the angle of slope of the side faces 24 of the edge blocks 20 and the upper and lower faces 6, 10 of the tetrahedral block 1, and is preferably sloped at an angle of 45 degrees to the upper face, like the corresponding faces of the mating blocks are sloped.

Furthermore, a hooking lip 72 and lip face 74 are formed on each side face 62, 64, and preferably project from the face perpendicularly. The hooking lips 72 respectively extend parallel to the upper face 52 from the first and second outer faces 54, 58 to the inner corner edge 70. With this structure, the corner block 50 is compatible with the edge and tetrahedral blocks 20, 1, and its hooking lips 72 can cooperatingly engage the hooking lips of these other blocks.

From the previous description of one of the preferred forms of the invention, it can be seen that a horizontally disposed assembly 80 of edge, corner and tetrahedral building blocks may be formed, as illustrated by FIG. 13, with the edge blocks 20 and corner blocks 50 forming the perimeter of the assembly 80, and the tetrahdral blocks 1 forming the central portion of the assembly.

In addition, the hooking lips of each of the edge, corner and tetrahedral blocks are adapted to engage and interlock with the lips of its own kind and of the other blocks, so that each block supports an adjacent block. This provides a structure which is not only self-supporting, that is, requiring no scaffolding or temporary support during or after its assembly, but also is suitable for load-bearing applications, as, for example, a floor slab or roadway, when subjected to a perimetal tension ring.

It can be seen from FIGS. 13–16 that the tetrahedral building blocks 1 are arranged with an upper face 6 of one block abutting a lower face 10 of an adjacent block to form an assembly of interconnected, partially overlapping blocks extending in a substantially horizontal plane.

A similar arrangement of building blocks may be formed with an alternative design of the present invention, which is illustrated by FIGS. 17–32 of the drawings.

In accordance with a fourth embodiment of the present invention shown in FIGS. 17–20, the tetrahedral block construction shown in FIGS. 1–4 may be modified so that the upper and lower block faces are not in the form of equilateral triangles, but rather are in the form of scalene triangles defined by side edges of different lengths.

More particularly, the building block 90 of the fourth embodiment includes a tetrahedrally shaped block body 91 which is rectangular when viewed in plan (as opposed to the embodiment of FIGS. 1–4 which appears square when viewed in plan). The embodiment of FIGS. 17–20 includes all of the same structural features as the tetrahedral block described previously in connection with FIGS. 1–4, including upper and lower triangular faces 92, 94, upper and lower edges 96, 98, side edges 100, 101 and hooking lips 102 and lip faces 104 formed on and projecting from the upper and lower faces. However, because the block appears rectangular when viewed in plan, the upper and lower edges 96, 98 are disposed transversely, as opposed to orthogonally as in the previous embodiment.

The upper and lower faces 92, 94 are in the form of scalene triangles, that is, they are defined by block edges that are unequal in length. Each face is defined by a first side edge 100, a second side edge 101 or an upper or lower edge 96, 98. Each first edge 100 constitutes a smaller side of the upper and lower triangular faces 92, 94, and is preferably one half the length of the second side edge 101. The first side edge 100 preferably forms an angle of 60 degrees, when the block is viewed in plan, or 67.79 degrees, when viewed isometrically, with the upper or lower edges 96, 98 of the block, whereas the second side edge 101 forms an angle of about 30 degrees, when the block is viewed in plan, or 39.97 degrees, when viewed isometrically, with the upper or lower edges 96, 98.

Figure 29:
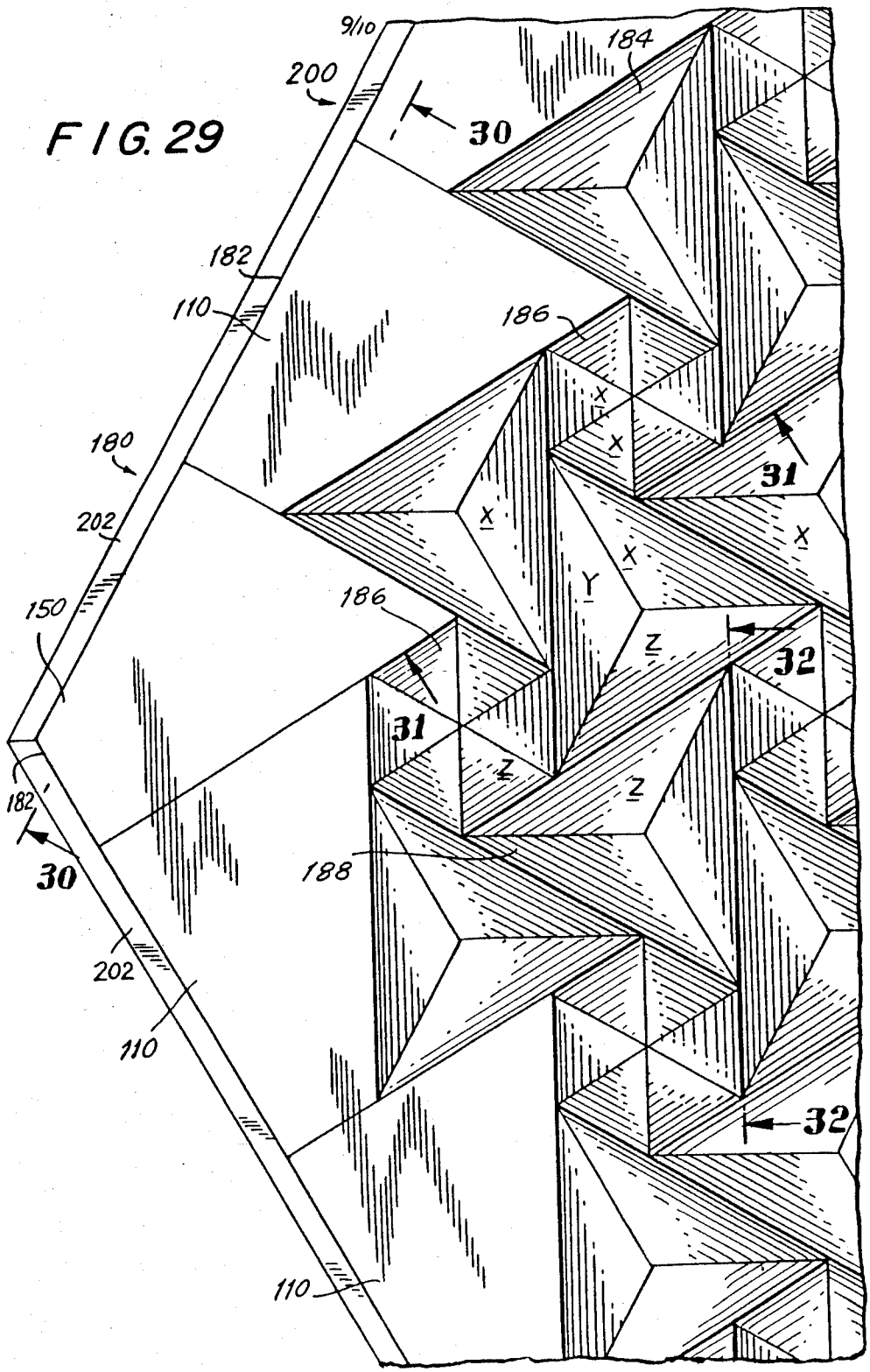
FIG. 29 is a partial top plan view of a horizontal supporting structure formed from the blocks shown in FIGS. 17-28.
Figure 30:
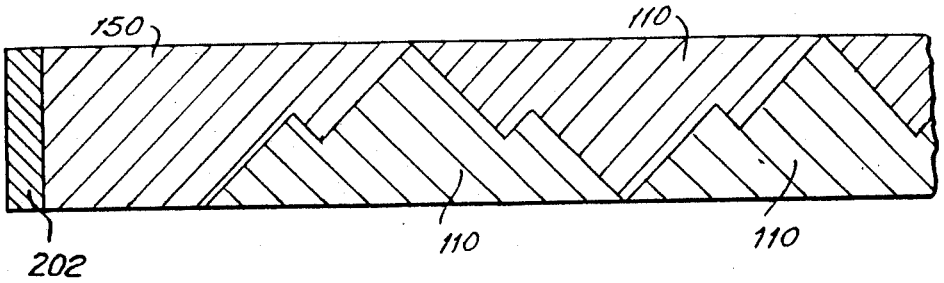
FIG. 30 is a section view of the structure shown in FIG. 29 taken along line 30—30 of FIG. 29.
Figure 31:
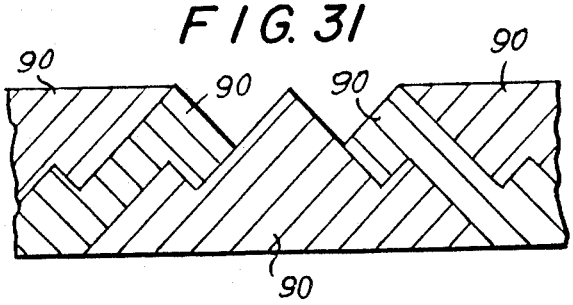
FIG. 31 is a section view of the structure shown in FIG. 29 taken along line 31—31 of FIG. 29.
Figure 32:
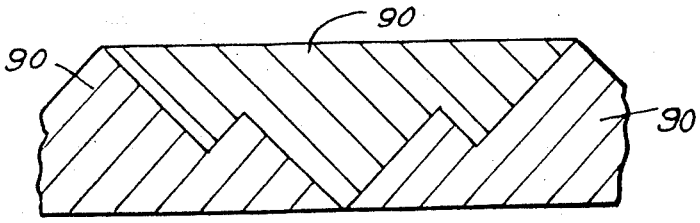
FIG. 32 is a section view of the structure shown in FIG. 29 taken along line 32—32 of FIG. 29.

As with the previous embodiment, the hooking lips 102 of the block of FIGS. 17–20 are disposed in parallel with either the upper edge 96 or the lower edge 98, and extend across their entire respective faces between the first and second side edges 100, 101. The lips 102 project preferably perpendicularly to the respective face on which they are formed. Furthermore, the upper and lower block faces 92, 94 are sloped at an angle of about 45 degrees (that is, the upper faces 92 mutually diverge from the upper edge 96, and the lower faces 94 mutually converge to define the lower dge 98, at an angle of about 90 degrees). With such structure, the block 90 may be oriented to engage similarly structured blocks to form a geometric assembly of blocks, as shown in FIG. 29.

In accordance with a fifth and sixth embodiment of the present invention, an edge block 110 and a corner block 150, adapted to interlock with the block 90 of FIGS. 17–20 and to form the perimeter or border of a horizontally disposed, self-supporting arrangement of blocks, are shown in FIGS. 21–24 and 25–28, respectively. Their structural features are similar in many respects to those of the edge and corner blocks 20, 50 of the previous embodiments.

Th edge block 110 illustrated by FIGS. 21–24 includes a quadrilateral planar upper face 112, an outer face 114 perpendicularly joined to the upper face 114, and sloping opposite first and second side edges 126, 128 of the upper face 112. Thus the perimeter of the upper face 112 is defined by the outer edge 116, inner edge 120 and first and second side edges 126, 128.

The side faces 122, 124 slope inwardly of the upper face 112 and are disposed at least partially beneath the upper face 112, and mutually converge to define a lower edge 130. The inner face 118 slopes downwardly from the inner edge 120 in a direction away from the outer face 114, and is joined to the side faces 122, 124. The lower edge 130 thus extends between the outer face 114 and a corner 132 of the inner face 118 defined by first and second inner edges 122, 124.

The length of the second side edge 128 is preferably three times the length of the first side edge 126. The side faces 122, 124 form an interior angle of about 45 degrees with the upper face 112, and converge at an angle of 90 degrees. The inner face 118 preferably forms an interior angle of about 135 degrees with the upper face 112.

A hooking lip 134 and lip face 136 extend across the inner face 118 from a first inner edge 138 (i.e., the corner edge defined by the first side face 122 and the inner face 118) to a second inner edge 140 (i.e., the corner edge defined by the second side face 124 and the inner face 118). The hooking lip 134 is positioned about midway on the inner face 118 and extends in parallel to the inner edge 120, and projects perpendicularly from the inner face 118.

Similarly, each side face 122, 124 includes a hooking lip 142 and lip face 144. Such hooking lips 142 and faces 144 extend across their entire respective side face, in parallel with the upper face 112 and lower edge 130, and are positioned about midway on their respective side face between the upper face 112 and the lower edge 130. Each hooking lip 142 and face 144 projects perpendicularly from its respective side face.

The edge block is designed with this particular configuration so that it can cooperatingly mate with the block 90 of FIGS. 17–20 and the corner block 150 of FIGS. 25–28, which will now be described in detail, to form the horizontal supporting assembly of blocks illustrated by FIGS. 29–32.

A corner block 150 formed in accordance with a sixth embodiment is shown in FIGS. 25–28. It includes quanrilateral planar upper and lower faces 152, 154. The lower face 154 is disposed partially beneath the upper face 152 and has a shape which is the mirror image of the upper face 152, when both are viewed in plan.

The block 150 further includes a first outer face 156 joined perpendicularly to each of the upper face 152 and the lower face 154, and a second outer face 158 joined to the first outer face 156, and perpendicularly joined to each of the upper and lower faces 152, 154. The second outer face 158 preferably forms an interior angle of 120 degrees with the first outer face 156. The first and second outer faces 156, 158 have similar shapes.

A sloping first inner face 160 slopes downwardly from the upper face 152 in a direction away from the first outer face 156 and joins the lower face 154 at a first inner edge 162 of the block. A sloping second inner face 164 slopes upwardly from the lower face 154 in a direction away from the second outer face 158 and joins the upper face 152 at a second inner edge 166 of the block.

A hooking lip 168 and lip face 170 are formed on each of the inner faces 160, 164 and extend entirely across their respective inner face. Each lip 168 is positioned about midway on its inner face 160, 164 and projects perpendicularly from the surface of the inner face. The lips 168 further extend in parallel with the first and second inner edges 162, 166 of the block.

The first inner face 160 forms interior angles of 45 degrees and 135 degrees with the lower and upper faces 154, 152, respectively, and similarly, the second inner face 164 forms interior angles of 45 degrees and 135 degrees with the upper and lower faces 152, 154, respectively. The first and second inner faces 160, 164 join each other to define a block edge 172 which slopes downwardly from a corner 174 of the upper face 152 to a corresponding corner 176 of the lower face 154.

The corner block 150 is adapted to mater with the edge block 110 of FIGS. 1–24 and the tetrahedral block 90 of FIGS. 17–20 to form a horizontal supporting structure 180 such as shown in FIGS. 29–32.

Figure 21:
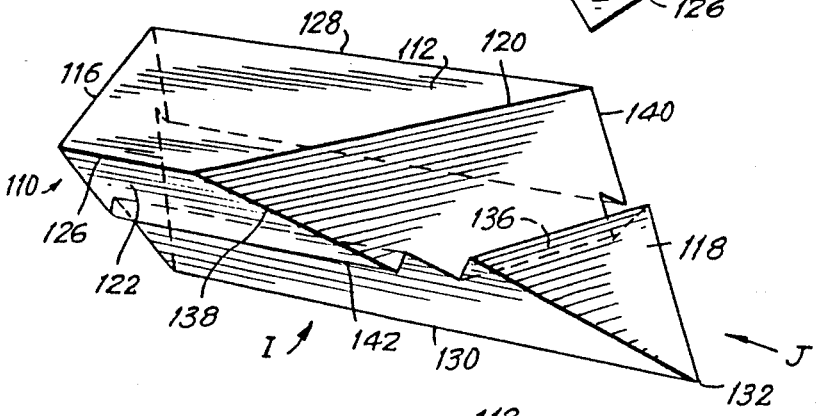
FIG. 21 is a perspective view of an edge building block formd in accordance with a fifth embodiment of the present invention.
Figure 23:
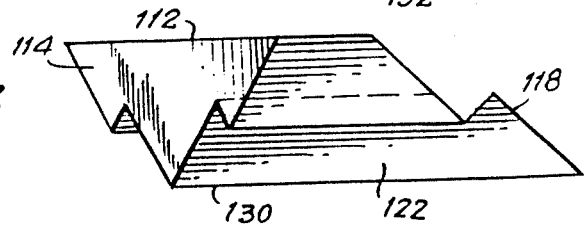
FIG. 23 is a side elevation view of the block shown in FIG. 21 viewed in th direction of arrow I.
Figure 24:
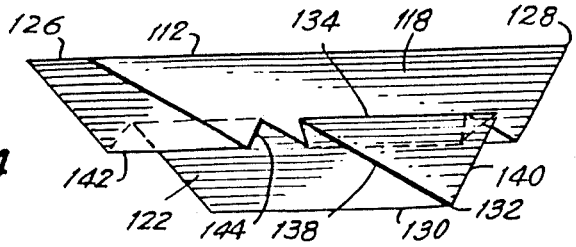
FIG. 24 is a side elevation view of th block shown in FIG. 21 viewed in the direction of arrow J.
Figure 25:
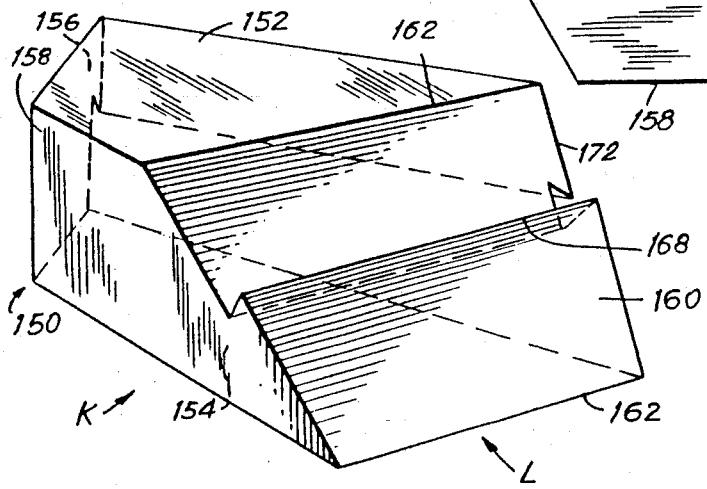
FIG. 25 is a corner building block formed in accordance with a sixth embodiment f the present invention.
Figure 26:
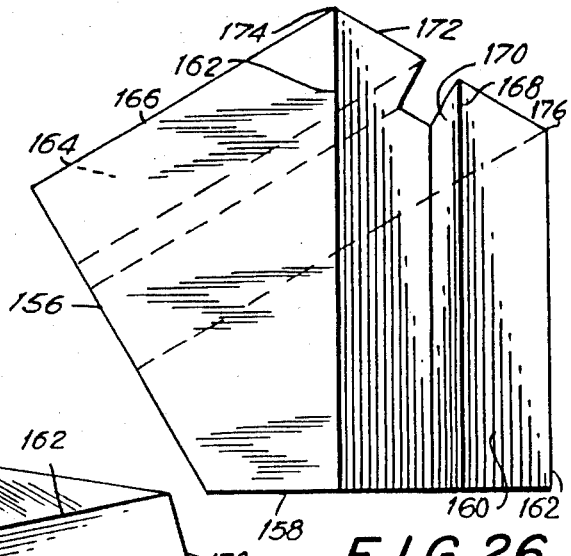
FIG. 26 is a top plan view of the block shown in FIG. 25.
Figure 27:
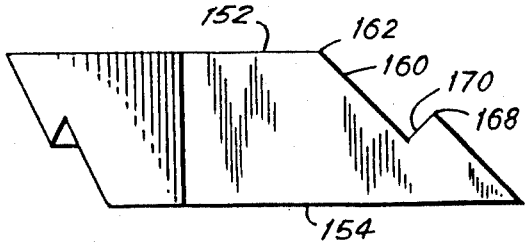
FIG. 27 is a side elevation view of th block shown in FIG. 25 viewed in the direction of arrow K.
Figure 28:
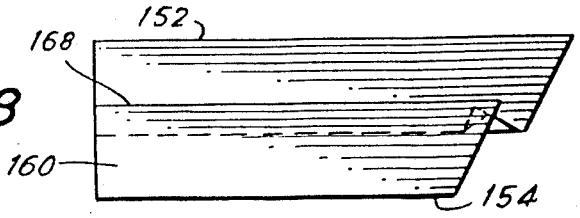
FIG. 28 is a side elevation view of the block shown in FIG. 25 viewed in th direction of arrow L.

With reference to FIGS. 29–32, it can be seen that the horizontal supporting structure 180 is formed by resting the second side face 124 of an edge block 110 on the first inner face 160 of the corner block 150 so that the corrsponding hooking lips 142, 168 on each face engage each other, and by resting the second inner face 164 of the same corner block 150 on the second side face 124 of an inverted edge block 110 with corresponding hooking lips of each engaged. The first side face 122 of another edge block 110, in its normal disposition as shown in FIG. 21, is positioned to rest on the first side face 122 of the inverted edge block. This pattern is repeated, with alternating inverted and non-inverted edge blocks 110, and corner blocks 150, to form a hexagonally shaped periphery 182 for the horizontal structure.

Each inverted edge block 110 supports adjacent edge or corner blocks 110, 150. The supported edge and corner blocks substantially abut each other at the lower edge 130 of the inverted edge blocks.

As can be envisioned by FIG. 29, the assembly of corner and edge blocks forms a peripheral structure 182 having a substantially flat composite surface, if the edge blocks 110 and corner blocks 150 are dimensioned to have the same height.

The inner core 184 of the horizontal supporting structure is formed from the tetrahedral blocks 90 of FIGS. 17–20 by engaging the hooking lips 102 of the tetrahedral blocks 90 with the hooking lips of adjacent tetrahedral blocks 90 and the edge and corner blocks 110, 150. The horizontal structure 180 may be constructed block-by-block in this manner, without an external support or scaffolding, because each block is self-supporting during construction. Only a perimetal tension ring 200 need be applied at erection's end. Such a tension ring may be in the form of a series of integral or interconnected reinforcing bars 202, such as used in post tension constructions.

The tetrahedral blocks 90 are added to the corner and edge blocks 150, 110 until the entire horizontal structure is formed as an assembly of interlocked blocks.

The height of the interior core 184 of the structure, comprisd primarily of interlocked tetrahedral blocks 90, will be the height of the periphery if the individual tetrahedral blocks 90 are formed with heights equal to those of the edge and corner blocks 110, 150.

As can be seen from FIG. 29, hexagonal depressions or "dimples" 186 are formed near the periphery and in the center of the structure and defined by interlocking six tetrahedral blocks 90 together, or with two edge blocks 110 and four tetrahedral block 90, or with two edge blocks 110, a corner block 150 and three tetrahedral blocks 90.

Also formed in the horizontal structure are triangular shaped dimples 188. These dimples 188 are formed by the interconnection between three adjacent tetrahedral blocks 90 or edge and corner blocks at the periphery of the structure.

Each of the hexagonal and triangular dimples 186, 188 may be filled with concrete or other material to a level equal to the height of the perimeter 182 of the structure 180 and the upper edges 96 of the tetrahedral blocks 90, to provide a flat surface, such as for use as a floor, roadway, etc.

As can be seen from FIG. 29, the upper and lower faces 92, 94 of the tetrahedral blocks 90 abut and overlap the lower and upper faces 94, 92 of adjacent blocks,, and that only three blocks are required for an overlapping circular sequence to recur (that is, block X overlaps block Y, which in turn overlaps block Z, which overlaps block X). This is because each successive block in the circular sequence shifts in orientation from its preceding block by 120 degrees, whereas the equilateral tetrahedral blocks 1 of the previous embodiment (FIGS. 1–4) are arranged to shift by 90 degrees in overlapping relationship.

The various block designs of the present invention described previously simplify the construction of load-bearing supporting structures without requiring the need for an external or secondary scaffolding during the construction of the structure. Each block is simple in structure and can be easily manufactured. The blocks may be formed from concrete, wood or other material suitable for load-bearing applications. Or, materials such as gypsum, foam rubber or some plastics may be used to form the blocks for applications in ceilings, toys and the like. Furthermore, the blocks may be oriented in a number of positions so that a variety of structures may be formed by interlocking the blocks together.

Because each block is provided with hooking lips on its faces, each block is self-supporting, which allows a load-bearing structure to be constructed block-by-block so that only a tensile ring is applied at the perimeter to counteract variable live loads.

Although illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention.

What is claimed is:

1. A building block adapted to be assembled with other blocks to form a structural unit, comprising a block body having a base surface with at least two edges substantially parallel to each other and two edges not parallel to each other.

a main edge situated distantly from said base surface and extending along longitudinal axis of the body, two first surfaces sloping in the direction of the main edge from said two substantially parallel edges, two second surfaces exposed at an angle to said flat surfaces, each said first surface crossing one said second surface along an intermediate edge, said intermediate edges extending between said base surface and said main edge in the direction substantially parallel to the longitudinal axis of the block body, two third surfaces sloping from said second surfaces in the direction of said main edge and defining second surfaces in the direction of said main edge and defining said main edge at an intersection of said two third surfaces, engaging means comprising a first lip face sloping from one said non-parallel edge in the direction of said main edge, a second lip face exposed at an angle and crossing said first lip face in a central part of said body, a third substantially triangular lip face exposed at an angle and connecting said second lip face with said main edge in such a manner that one angle of the triangle contacts said main edge.

2. A building block adapted to be assembled with other blocks to form a structural unit, comprising:

a block body having a first and second base surfaces spaced from each other, at least two edges of said first surface are not parallel to each other, at least three side surfaces interconnecting said first and second base surfaces, said side surfaces being exposed to each other at an angle, engaging means comprising a first lip face sloping from one said non-parallel edge of the first base surface in the direction of the second base surface, a second lip face exposed at an angle and crossing said first lip face in a central portion of said body, a third lip face exposed at an angle and connecting said second lip face with said second base surface.

3. A building block according to claim 2 wherein said first and second base surfaces are substantially parallel to each other.

* * * * *